US006520848B1

(12) United States Patent
Grant

(10) Patent No.: US 6,520,848 B1
(45) Date of Patent: Feb. 18, 2003

(54) METHOD AND APPARATUS FOR MAINTAINING THE RELEASE OF EXHAUST ABOVE A HEIGHT THRESHOLD

(75) Inventor: Dennis Grant, Newberg, OR (US)

(73) Assignee: CH2M Hill Industrial Design & Construction, Inc., Portland, OR (US)

( * ) Notice: Subject to any disclaimer, the term of this patent is extended or adjusted under 35 U.S.C. 154(b) by 0 days.

(21) Appl. No.: 09/965,975

(22) Filed: Sep. 28, 2001

(51) Int. Cl.[7] ..... F23L 17/02

(52) U.S. Cl. ..... 454/26; 110/184; 454/30; 454/31

(58) Field of Search ..... 454/1, 2, 26, 27, 454/30, 31; 110/184, 163

(56) References Cited

U.S. PATENT DOCUMENTS

| | | | | | |
|---|---|---|---|---|---|
| 2,258,961 | A | * | 10/1941 | Saathoff | 110/162 |
| 4,095,514 | A | * | 6/1978 | Roy et al. | 110/184 |
| 4,204,463 | A | * | 5/1980 | Carty | 110/184 |
| 4,319,141 | A | * | 3/1982 | Schmugge | 290/52 |
| 5,131,474 | A | * | 7/1992 | Hunter, III | 169/46 |

FOREIGN PATENT DOCUMENTS

JP 63-267813 * 11/1988

* cited by examiner

*Primary Examiner*—Harold Joyce
(74) *Attorney, Agent, or Firm*—Innovation Partners; Charles E. Gotlieb

(57) ABSTRACT

A method and apparatus adjusts an opening in the flow of exhaust to ensure a constant velocity of the exhaust.

28 Claims, 2 Drawing Sheets

METHOD AND APPARATUS FOR MAINTAINING THE RELEASE OF EXHAUST ABOVE A HEIGHT THRESHOLD

FIELD OF THE INVENTION

The present invention is related to manufacturing facilities and more specifically to exhaust systems in manufacturing facilities.

BACKGROUND OF THE INVENTION

Some manufacturing facilities house manufacturing equipment and employees in a tightly controlled environment to minimize contamination that can adversely affect the manufacturing process. Semiconductor manufacturing facilities, known as cleanrooms, are an example of such facilities, although the present invention is not limited to semiconductor manufacturing facilities.

Operation and activities that occur during the production of products may produce contaminants that can adversely affect the purity of the air in the facility. For example, the operation of the semiconductor equipment produces noxious pollutants in the process exhaust. The operators themselves also consume oxygen and produce carbon dioxide and other gases that must be removed from the facility.

To preserve the purity of the air in the manufacturing facility, thereby avoiding contamination of the products produced therein, and to protect the health of the workers in the facility, contaminated air must be exhausted from the facility to ambient air outside the facility. When air in a tightly controlled facility is exhausted, costly make-up air must be reintroduced into the facility to maintain sufficient air pressure in the facility. If the air pressure of the facility is not maintained at a higher pressure than the outside air, unpurified outside air will enter the semiconductor fabrication plant through holes and cracks in the facility that lead to the ambient air outside the facility. Thus, as air in the plant and process exhaust is exhausted, make-up air from outside the plant must be highly purified and then blown into the plant to maintain the pressure. Supplying the make-up air incurs an expense which must be borne, including the cost of energy and maintenance costs associated with both the filtration equipment and the blowers.

Because the exhaust from a semiconductor fabrication plant tends to include noxious elements, process exhaust must be released from the plant into the atmosphere at heights determined to be environmentally prudent. However, plants built with taller stacks tend to be aesthetically unappealing and may exceed maximum height ceilings imposed by local governments. To ensure that exhaust from short stacks reaches a height that is higher than the top of the stack, the exhaust is released at a sufficiently high velocity to ensure the exhaust reaches the required height before disseminating into the ambient air outside of the plant. The velocity of the exhaust is based upon the flow of the exhaust and the cross-sectional area of the stack. Thus, it is possible to size the cross-sectional area of the stack to ensure a velocity of the exhaust that can ensure the exhaust reaches a required height under normal operating conditions.

Semiconductor manufacturing plants and other types of manufacturing plants are frequently built in stages. For example, the plant may be built one quarter at a time. In addition, portions built may not be fully operational for various reasons. However, conventional stacks the plant will use for exhaust purposes are built to accommodate the plant when it is fully built and operational. Thus, the cross-sectional area of the stacks are sized to ensure a velocity to allow the exhaust from the plant to reach the desired height only when the plant is fully built and operational. During periods in which the plant is not fully built and operational, the flow of exhaust is less than it will be when the plant is fully built and operational. Thus, the cross-sectional area of the stacks is too large for the flow of the exhaust to allow the exhaust to reach the required height.

To ensure the flow of exhaust reaches the desired height, the air flow of the exhaust may be increased. There are two methods traditionally used to increase the airflow through the stack during periods when the plant is not fully built or operational. One method increases the flow of filtered air through the semiconductor-fabrication plant by employing more blowers, running existing blowers at a higher speed or both. The increased air flow results in increased flow of the exhaust release to maintain the ultimate height of the exhaust. However, because greater volumes of air are filtered and blown, this method increases the costs of supplying make up air and increases the energy costs of the blowers beyond what is necessary to remove the exhaust from the manufacturing facility.

A lower cost arrangement for increasing the flow of exhaust when the facility is not fully built or operational is referred to as induction. Using induction, blowers blow outside air directly into the exhaust stream itself to increase the flow of exhaust. Induction reduces the expense associated with increasing the flow of air because the air from the induction blowers that is blown into the exhaust stack does not need to be as highly purified as the make-up air blown into the manufacturing facility. Nevertheless, the induction blowers increase energy costs and because the induction blowers require maintenance, their use increase maintenance expenditures beyond those necessary for removing exhaust from the facility.

Another weakness of both methods described above is their inability to sense and respond automatically to changes in air flow that occur during day-to-day operations of the fabrication plant. The background art does contain a solution to this problem, using an apparatus for maintaining air flow in a work chamber at a constant velocity by sensing the velocity of the exhaust and adjusting the speed of a blower to compensate (Gray, U.S. Pat. No. 5,356,334, issued Oct. 18, 1994). However, because the Gray apparatus depends upon regulation of air flow by a blower means for moving air, a system or method for maintaining high velocity exhaust release that incorporated the Gray apparatus would still be associated with the energy and maintenance and cost inefficiencies of increased air flow described using one of the two methods described above.

What is needed is a method and apparatus for maintaining exhaust release height above a threshold that senses and responds automatically to changes in air flow that does not rely on increasing the flow of the exhaust.

SUMMARY OF INVENTION

Velocity of exhaust is maintained above a threshold velocity by an automatic detection and control system that manipulates the cross-sectional area of an opening through which the exhaust is released. The automatic detection and control system ensures that, despite changes in air flow generated by an upstream process, the released exhaust and any noxious elements in it are discharged at a constant velocity to help ensure the exhaust disseminates into the atmosphere at an environmentally safe height.

DETAILED DESCRIPTION OF A PREFERRED EMBODIMENT

Figure 1A:
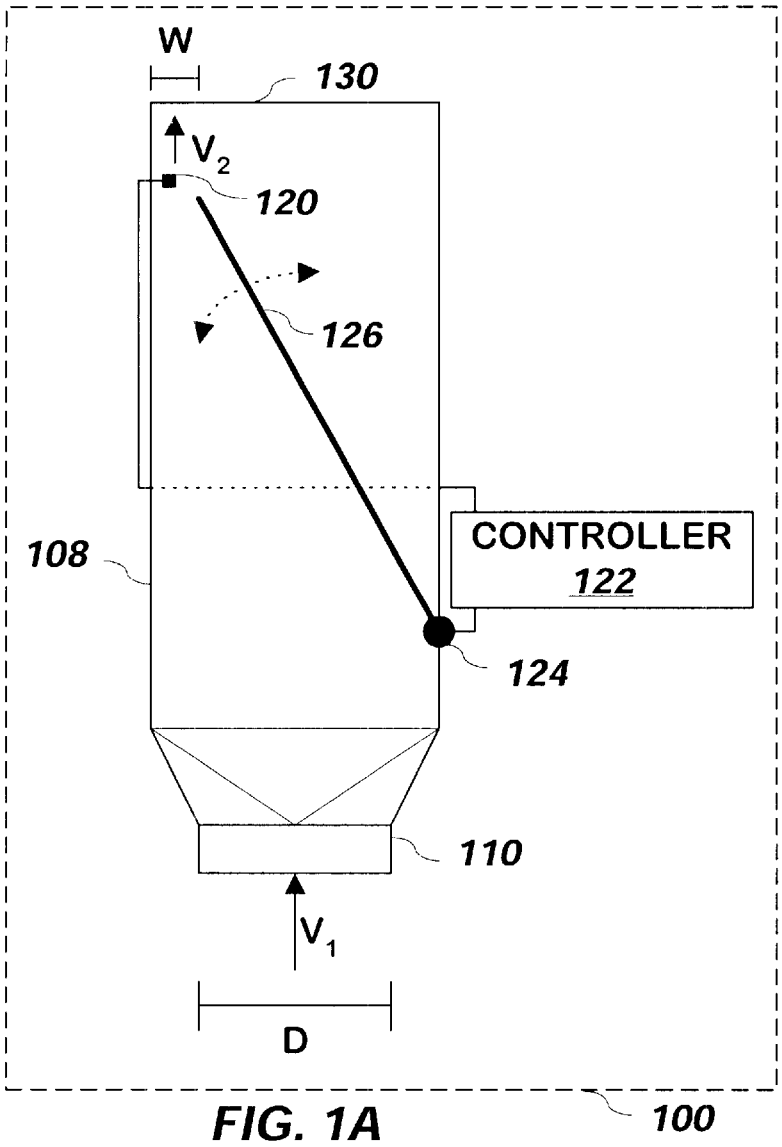
FIG. 1A is a block schematic diagram of an apparatus for releasing exhaust that automatically maintains an exhaust release velocity above a threshold, according to one embodiment of the present invention.

Referring now to FIG. 1A, an apparatus 100 for automatically maintaining an exhaust release velocity above a threshold is shown according to one embodiment of the present invention. The apparatus described below is not limited to use in semiconductor fabrication plants, but may be used to handle the exhaust of any type of facility or product.

In one embodiment of the present invention, an exhaust stream enters enclosure 108 through enclosure portal 110 at an initial velocity $V_1$. Enclosure 108 may be a conventional stack such as may be used to release exhaust in conventional manufacturing plants, modified as described herein. Enclosure 108 may also be a box, a room, or some other enclosed space capable of receiving and releasing gases. The exhaust stream may include toxic gas, non-toxic gas, volatile organic compounds (VOCs), combustible gas or hazardous gas or any other material sent through a conventional exhaust stream.

In one embodiment, sensor 120 detects at least one characteristic of the exhaust stream as the exhaust stream moves past sensor 120. A characteristic to be detected is one that can be used to determine $V_2$, such as a velocity of, or a pressure exerted by, the exhaust stream as it exits the enclosure 108. Sensor 120 measures the characteristic or characteristics and provides the corresponding measurement or measurements to controller 122.

In one embodiment, after receiving the measurement or measurements from sensor 120, controller 122 identifies or calculates $V_2$. Controller 120 determines if $V_2$ is below, exceeds or is approximately equal to the desired velocity that will cause the exhaust to attain a desired height before dissipating. This threshold may be determined using calculations from chapter 16 of, 2001 ASHRAE Handbook Fundamentals commercially available at the Web site of ASHRAE.org, or using the conventional Flowvent air flow modeling tool commercially available from Flowmerics of Southborough, Mass. The threshold velocity may be a function of the wind speed of the ambient air, and either the prevailing wind conditions may be used in one embodiment, or 7.5 to 15 miles per hour winds may be used in another embodiment. If $V_2$ is approximately the desired velocity, controller 122 does not adjust control actuator 124, maintaining the exit exhaust width W. Otherwise, if $V_2$ is below the desired velocity, controller 122 adjusts control actuator 124 which angles damper 126 to cause the exit exhaust width W to decrease; and if $V_2$ is above the desired velocity, controller 122 adjusts control actuator 124 which angles damper 126 to cause the exit exhaust width W to increase.

The process of measurement and adjustment may be repeated periodically or continuously to allow the apparatus 100 to adjust for fluctuations in the flow of exhaust.

Damper 126 may be any device that controls the size of an opening through which exhaust flows. It can be helpful to ensure that the design of the damper 126 promotes a somewhat laminar flow of the exhaust past the most constricting portion of the damper to ensure the air flowing past the damper reaches the desired height, although a perfect laminar flow is not required by the present invention.

It isn't necessary to place sensor 120 in the stream of the exiting exhaust, as it is possible to calculate the velocity of the exiting exhaust using the velocity of the exhaust at any location and make the appropriate adjustments to actuator 124. To do so, controller 122 may first calculate Q, where Q is the air flow of the exhaust stream as it enters and exits enclosure 108. The equation used is $$Q=V_1A_1 \quad \text{(Eq. 1)}$$

where $A_1$ is a known cross-sectional area of the enclosure at the location of sensor 122. For example, sensor 122 may be placed at portal 110 and the measured value of $A_1$ identified and stored in controller 122. Next, using the calculated Q, controller 122 calculates a desired cross-sectional area $A_2$, the cross sectional area at the upper end of damper 126. The equation used is:

$$A_2=Q/V_2, \quad \text{(Eq. 2)}$$

where $V_2$ is the desired velocity threshold also stored in controller 122.

Figure 1B:
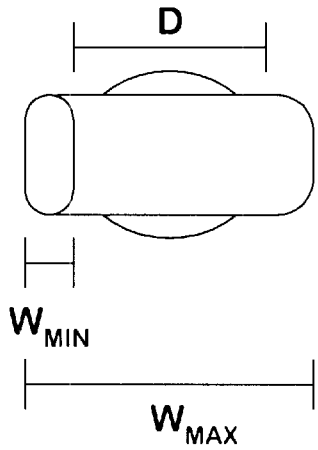
FIG. 1B is a block schematic diagram of an opening in an apparatus through which exhaust is released, according to one embodiment of the present invention.

Finally, adjustable velocity control actuator 124 calculates the exit width W at the opening created by the end of damper 126 such that the cross-sectional area of the opening equals $A_2$. As shown in FIG. 1B, W can vary over a range $W_{MIN}$ to $W_{MAX}$. Controller 122 signals actuator 124 to move damper 126 to create an opening of width W calculated as described above.

To exit enclosure 108, the exhaust stream moves at $V_2$ through the opening of width W and then through enclosure outlet 130.

Figure 2A:
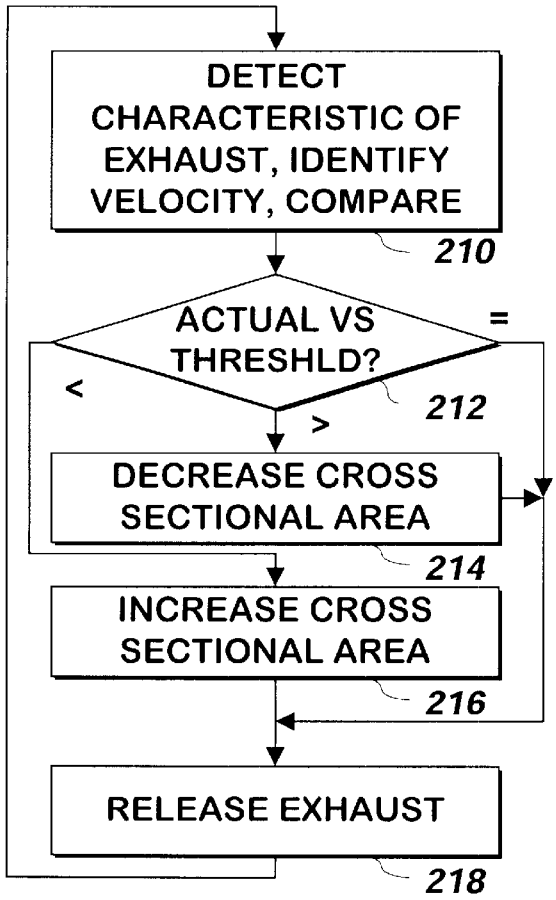
FIG. 2A is a flowchart illustrating a method for releasing exhaust at a velocity above a threshold according to one embodiment of the present invention.

Referring now to FIG. 2A, a method of releasing exhaust is shown according to one embodiment of the present invention. A characteristic of the exhaust that may be used to determine the velocity of exhaust is detected 210 and the velocity is identified and compared with a threshold as described above. The characteristic may be detected at, near or downstream of the most constricting portion of a damper controlling a cross sectional area of a space through which the exhaust flows.

If the velocity identified in step 210 is approximately equal to a threshold velocity 212, the exhaust is released 218. Otherwise if the velocity identified in step 210 exceeds the threshold velocity, the cross sectional area of an opening through which the exhaust flows is increased 216, and if the velocity identified in step 210 is less than the threshold velocity, the cross sectional area of an opening through which the exhaust flows is decreased 214, and the method continues at step 218. In one embodiment, following step 218, the method continues at step 210 in a continuous or periodic process.

Figure 2B:
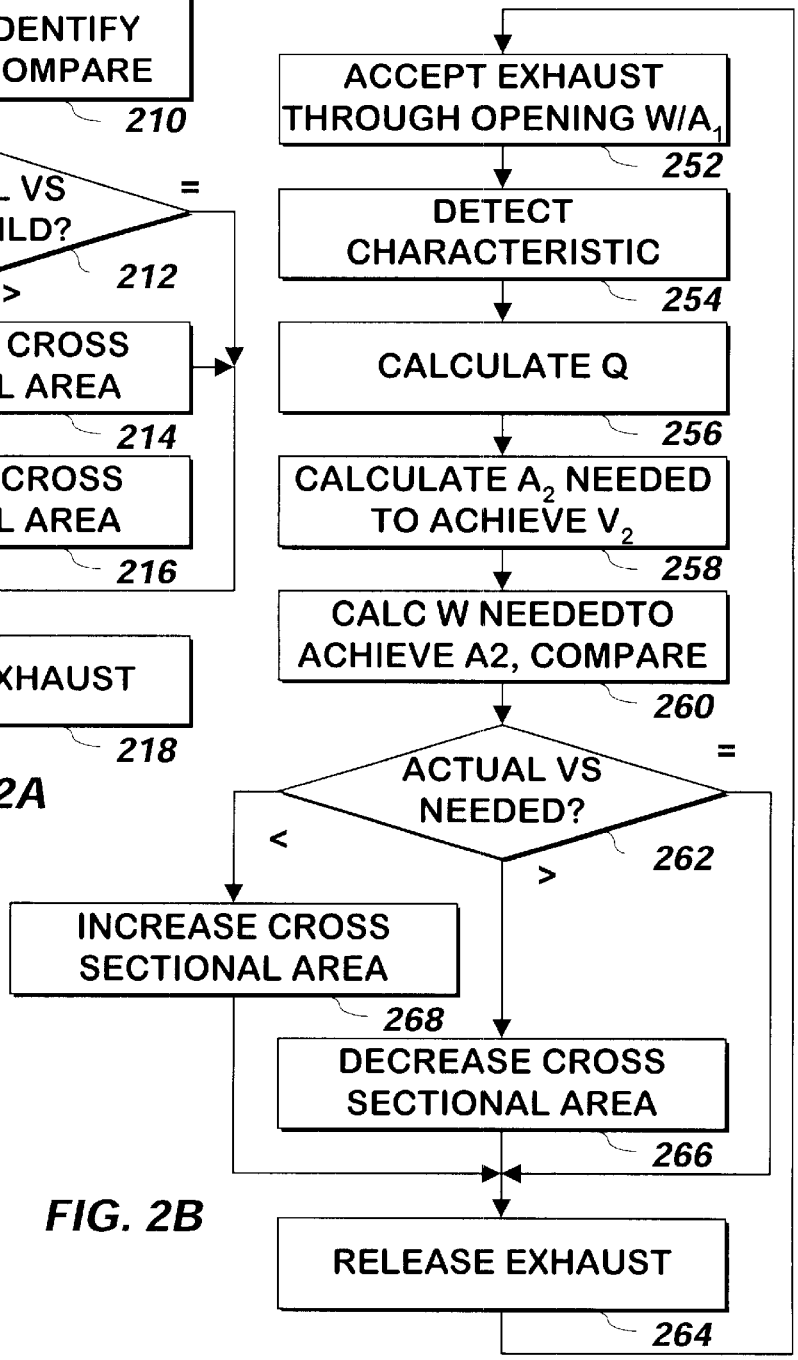
FIG. 2B is a flowchart illustrating a method for releasing exhaust at a velocity above a threshold according to an alternate embodiment of the present invention.

Referring now to FIG. 2B, a method for releasing exhaust at a velocity above a threshold is shown according to an alternate embodiment of the present invention. The exhaust is accepted 252 via a place having a known cross-sectional area $A_1$. A quantity of a characteristic, such as velocity or pressure is detected 254 at or near the place with the known cross-sectional area. A flow Q is calculated 256 using the detected characteristic and cross sectional area $A_1$ as described above.

The flow calculated in step 256 is used to determine 258 a desired cross-sectional area $A_2$ at which the velocity of the exhaust stream would be $V_2$, a desired exhaust release velocity. A desired width W associated with $A_2$ may optionally be calculated using the $A_2$ calculated in step 258 and either the desired $A_2$ calculated in step 260 or the desired width calculated in step 258 is compared with an existing, or actual, area or width of an opening as described above.

If the actual width or area is approximately equal to the desired width or opening 262, the exhaust is released 264. If the actual width or area is less than the desired width or area 262, the cross sectional or width is increased 268 and the method continues at step 264. If the actual width or area is greater than the desired width or area 262, the cross sectional or width is decreased 266 and the method continues at step 264. In one embodiment, following step 264, the method continues at step 252 in a continuous process.

What is claimed is:

1. A method of providing an exhaust from a port, comprising:

detecting a characteristic of the exhaust;

identifying a threshold velocity to substantially achieve a desired height of the exhaust above the top of the port in the presence of at least one selected from an actual speed of a wind, a speed of a prevailing wind and a constant range of wind speeds; and responsive to the detecting step, adjusting an opening to cause the exhaust to have a velocity at the opening exceeding the threshold velocity.

2. The method of claim 1 wherein the characteristic comprises a second velocity.

3. The method of claim 1 wherein the characteristic comprises a pressure.

4. The method of claim 1 wherein the adjusting step is responsive to a calculation of one selected from a width and an area.

5. The method of claim 1 wherein the exhaust is provided substantially vertically.

6. The method of claim 1 wherein the exhaust comprises at least one toxic gas.

7. The method of claim 1 wherein the exhaust comprises at least one non-toxic gas.

8. The method of claim 1 wherein the exhaust comprises at least one gas containing a volatile organic compound.

9. The method of claim 1 wherein the exhaust comprises at least one flammable gas.

10. The method of claim 1 wherein the exhaust comprises at least one combustible gas.

11. The method of claim 1 wherein the exhaust comprises at least one hazardous gas.

12. The method of claim 1 wherein the exhaust comprises semiconductor fabrication process equipment exhaust.

13. The method of claim 1 wherein the identifying the threshold velocity comprises identifying the threshold velocity to achieve the desired height of the exhaust above the top of the port in the presence of the speed of the prevailing wind.

14. The method of claim 1 wherein the identifying the threshold velocity comprises identifying the threshold velocity to achieve the desired height of the exhaust above the top of the port in the presence of the constant range of wind speeds.

15. An apparatus for providing an exhaust from a port, comprising:

a sensor for detecting a characteristic of the exhaust and providing a quantity of the characteristic at an output;

a controllable damper for adjusting an opening responsive to signal received at an input; and a controller having an input coupled to the sensor output, the controller for:

identifying a threshold velocity to substantially achieve a desired height of the exhaust above the top of the port in the presence of at least one selected from an actual speed of a wind, a speed of a prevailing wind and a constant range of wind speeds; and providing the signal at an output coupled to the adjustable damper input so as to cause the damper to allow the exhaust to have a velocity at a damper opening exceeding the threshold velocity.

16. The apparatus of claim 15 wherein the characteristic comprises a second velocity.

17. The apparatus of claim 15 wherein the characteristic comprises a pressure.

18. The apparatus of claim 15 wherein the controller provides the signal responsive to a calculation of one selected from a width and an area.

19. The apparatus of claim 15 additionally comprising an enclosure containing the damper, the enclosure providing the exhaust to ambient air substantially vertically.

20. The apparatus of claim 15 wherein the exhaust comprises at least one toxic gas.

21. The apparatus of claim 15 wherein the exhaust comprises at least one non-toxic gas.

22. The apparatus of claim 15 wherein the exhaust comprises at least one gas containing a volatile organic compound.

23. The apparatus of claim 15 wherein the exhaust comprises at least one flammable gas.

24. The apparatus of claim 15 wherein the exhaust comprises at least one combustible gas.

25. The apparatus of claim 15 wherein the exhaust comprises at least one hazardous gas.

26. The apparatus of claim 15 wherein the exhaust comprises semiconductor fabrication process equipment exhaust.

27. The system of claim 15, wherein the controller identifies the threshold velocity by identifying the threshold velocity to achieve the desired height of the exhaust above the top of the port in the presence of the speed of the prevailing wind.

28. The system of claim 15, wherein the controller identifies the threshold velocity by identifying the threshold velocity to achieve the desired height of the exhaust above the top of the port in the presence of the constant range of wind speeds.

* * * * *